United States Patent [19]

Alten

[11] Patent Number: 4,765,595

[45] Date of Patent: Aug. 23, 1988

[54] SCISSOR JACK

[75] Inventor: Ferdinand Alten, Mandern, Fed. Rep. of Germany

[73] Assignee: August Bilstein GmbH & Co. KG, Ennepetal-Altenvoerde, Fed. Rep. of Germany

[21] Appl. No.: 53,596

[22] Filed: May 20, 1987

Related U.S. Application Data

[62] Division of Ser. No. 850,499, Apr. 10, 1986, abandoned.

[30] Foreign Application Priority Data

May 10, 1985 [DE] Fed. Rep. of Germany ... 8513829[U]
Aug. 9, 1985 [DE] Fed. Rep. of Germany ... 8522952[U]

[51] Int. Cl.[4] ..... B66F 3/00
[52] U.S. Cl. ..... 254/126; 254/122
[58] Field of Search ..... 254/124, 126, 122

[56] References Cited

U.S. PATENT DOCUMENTS

| | | | |
|---|---|---|---|
| 1,576,721 | 3/1926 | Conrad | 254/126 X |
| 1,926,610 | 9/1933 | Berglund | 254/126 |
| 1,954,558 | 4/1934 | Conrad | 254/126 |
| 2,071,470 | 2/1937 | Marlowe | 254/126 |
| 2,467,657 | 4/1949 | Brown | 254/126 X |
| 2,508,934 | 5/1950 | Berg | 254/126 X |
| 2,667,328 | 1/1954 | White | 254/126 |
| 3,210,048 | 10/1965 | Redman | 254/126 X |

FOREIGN PATENT DOCUMENTS

| | | | |
|---|---|---|---|
| 2427443 | 12/1975 | Fed. Rep. of Germany . | |
| 8313974.5 | 10/1984 | Fed. Rep. of Germany . | |
| 2030108 | 4/1980 | United Kingdom | 254/126 |

*Primary Examiner*—Frederick R. Schmidt
*Assistant Examiner*—Judy J. Hartman
*Attorney, Agent, or Firm*—Herbert Dubno; Andrew Wilford

[57] ABSTRACT

A scissor jack has a leg having a lower end adapted to bear on the ground, a support arm having a lower end pivoted on an opposite upper end of the leg at an intermediate horizontal axis, and a load-bearing member engageable with the vehicle body and formed on an opposite upper end of the intermediate support arm. Upper and lower links are pivoted together at another intermediate horizontal axis with the upper link also pivotal on the support arm between the ends thereof at an upper horizontal link axis and the lower link also pivotal on the leg between the ends thereof at a lower horizontal link axis. A jack screw is connected between the intermediate axes and can draw the intermediate link axes toward one another to raise the load-bearing member or separate the intermediate link axes to lower the load-bearing member. A foot piece can rock on the lower end of the leg relative to the ground about a lower horizontal foot axis as the leg is raised and lowered. A control brace fixed on the lower link projects therefrom past the leg and beyond the lower horizontal link axis to support the jack in a raised position with the lower link axis above the ground. This brace has an outer end operatively engageable with the ground and forming a lower horizontal brace axis spaced from the other axes such that it always defines with the lower foot axis a plane generally parallel to a plane defined by the intermediate link axes.

6 Claims, 3 Drawing Sheets

SCISSOR JACK

This is a divisional of co-pending application Ser. No. 06/850,499 filed on Apr. 10, 1986, now abandoned.

FIELD OF THE INVENTION

My present invention relates to a jack, lifting device or the like, and more particularly to a scissors jack for lifting the body of a vehicle to change a tire, to gain access to the underside of the vehicle or for some other purpose.

BACKGROUND OF THE INVENTION

Conventionally a scissors jack for lifting a vehicle has comprised a leg, a first supporting arm attached to it pivotable around a horizontal pivot axis and having a load bearing member at its free end and a jack screw. One end of the jack screw engages a jack screw nut at the upper end of the leg and the other end engages in a jack screw bearing at a pivot joint connecting a second and third supporting arm or bracing arm with each other. The second supporting arm is pivotally connected to the first supporting arm. The third supporting arm is pivotally connected to the leg which can have a foot piece attached to its lower end.

The scissors jack of German Utility Model DE-GM No. 83 13 974.5 has a pivotally mounted foot piece. It obliges the operator of the scissors jack to adjust the leg into the properly slanted position to lift the vehicle, so that the load bearing member in all configurations of the scissors jack lies above the point of the foot piece and/or in the friction cone extending from the point of the foot piece to prevent the jack from slipping under a load.

Slipping of the scissors jack is a particular problem because a vehicle must be liftable from several different starting positions, namely from a lowest position in which the fully loaded vehicle has flattened tires and from other positions in which the vehicle is unloaded and has intact tires.

The friction cone is defined as a cone having as its apex the support point on the ground and an apex angle within which the horizontal force component of the load cannot overcome the friction resisting displacement so that no slip can occur if the load point lies within this imaginary cone. The cone angle is determined by the coefficient of sliding friction of the support point on the ground.

A scissors jack as described in German Open Application DE-OS No. 24 27 443 has a roller foot at the lower end of its leg provided with a plane contacting surface. With this roller foot and/or contacting surface the scissors jack and/or the leg is adjusted to the properly slanted position. However with this scissors jack it is necessary that it and its rolling foot be adjusted or fitted to the vehicle to be lifted. This scissors jack is satisfactory for many purposes but cannot be used universally for all types of vehicles.

OBJECTS OF THE INVENTION

It is an object of my invention to provide an improved scissors jack for lifting a vehicle which obviates drawbacks of earlier jacks.

It is also an object of my invention to provide an improved scissors jack which can be put, independently of the type of vehicle to be lifted, into a position from which the vehicle can be lifted without the jack tipping or slipping.

Still another object of my invention is to provide a jack for the purposes described which will prop not only the support leg upon the ground but also one of the bracing arms at two spaced apart points for greater ease of setup and lifting reliability and safety.

SUMMARY OF THE INVENTION

These objects and others which will become more readily apparent hereinafter are attained in accordance with my invention in a scissors jack comprising a leg, a first supporting arm which is attached to it pivotable around a horizontal pivot axis and which has a load bearing member at its free end and a jack screw. One end of the jack screw engages a jack screw nut at the upper end of the leg and the other end engages in a jack screw bearing at a pivot joint connecting a second and third supporting arm or link with each other. The second supporting arm is pivotally connected to the first supporting arm. The third supporting arm is pivotally connected to the leg which has a foot piece attached to its lower end.

According to my invention so that the scissors jack can be set independently of the type of the vehicle to be lifted in a position from which the vehicle can be lifted without the jack slipping, a control brace is used to maintain the inclination the scissors jack takes at the beginning of the lifting process.

The control brace provides a support point directly or indirectly against the ground which is always spaced from a support point of the leg about which the leg can roll.

It will be understood that the support point need not engage the ground directly, but can have its force transmitted to the ground through the intermediary of a plate.

This control brace can be a rigid piece attached to the third supporting arm pivotally connected to the leg, extending above the pivot axis for the third supporting arm and the leg, and braceable on the ground.

Alternatively the control brace can be pivotally connected to the foot piece, which is pivotally connected to the leg, to the jack screw operating side at the supporting point for the leg and to the third supporting arm at the jack screw operating side of the pivot joint axis of the third supporting arm and the leg.

In the first embodiment of my invention mentioned above it is of particular significance that the configuration of the scissors jack during its mounting to the vehicle allows a rigid control brace. This control brace is of simple and economical manufacture.

The control brace can rest on the ground in all starting and incipient loading positions of the jack. As soon as the vehicle is lifted, the control brace contact surface leaves the ground and the leg can pivot about its supporting point on the foot piece. As a result moments do not occur due to the vehicle motion on lifting—as with conventional scissors jacks.

In the second embodiment mentioned above the control brace is a permanent connection between the third supporting arm and the foot piece and in the resting configuration of the scissors jack is positioned approximately parallel to the leg. With increasing vertical orientation of the third supporting arm the direct connection by the control brace effects this vertical orientation so that the leg is correspondingly lifted. As a result the first supporting arm is raised by the third supporting arm and therefore its load bearing member.

The kinematics can be so determined by choice of the position of pivotal connection of the control brace that the load bearing member in all initial positions of the scissors jack lies in the friction cone above the point of support of the leg on the foot piece.

In my scissors jack set forth above its motions and the motions of its control brace are such that no increased force is exerted on the control brace during the lifting of the vehicle. Some qualifications however must be made for some scissors jack structures according to my invention, particularly when the vehicles to be raised have very different motion paths because of the considerable and also unforeseeable pivotal motions of the leg which load the control brace. In order to relieve the control brace and the pivot joint in the leg and the third supporting arm from loading or excess loading, the control brace can be a part which can change its shape according to the relative motion of its pivot joints during the raising or lifting process. The control brace can thus be composed of for example hard rubber and can take the weight load experienced in scissors jack operation. As soon as motion of the leg is forced as a result of loading by forces acting on the vehicle, which space the pivot joints further apart or bring them closer together, the material of the control brace allows a suitable shape change and thus the forced displacement of its pivot joints.

The pivot joints of the control brace comprise strong axial pins rigidly attached at one end, which are formed by a protruding member of the foot piece and by a bent piece in the third supporting arm. The pivot joints of the control arm can of course be integral parts of the third supporting arm and the foot piece. Since the later normally are made from sheet metal and are stamped metal parts, the pivot joints and the axial pins forming them can be made in a process together with the third supporting arm and the foot piece. It is not necessary to use axial bolts for these pivot joints which are so strong that they can function as or be provided with special attaching means in the scissors jack, for example as rivets or the like. The comparatively thin but strong axial pin suffices for the loads occurring from the forces due to the weight on the scissors jack and the forces transmitted from the preferably elastic control brace.

The control brace projects into the supporting region of the foot piece which is formed as rigid roller foot mounted on the leg and has an opening for the rigid control brace attached to the control brace. The control brace can also be kept suitably compact. The opening is then required when the control brace must be supported on the ground in the supporting region of the foot piece.

In one form of my invention the foot piece is supported pivotally on the leg and has a supporting plate on which the control brace is braced. The foot piece and/or the supporting plate cooperate to provide the control brace continually with definite supporting conditions so that the effect of soft ground on the support and thus on the reliability of the jack's performance is nullified.

The control brace is provided on its free end with a curved supporting surface directed toward the leg. Thus a continuously adequate supporting surface on the ground end of the control brace is provided.

In another form of my invention the leg has reinforcing pieces on its exterior edges adjacent the foot piece. The resulting strengthening of the leg near the foot piece guarantees that there is sufficient space between the reinforcing pieces for the axial pin and also a large size control brace.

Furthermore the leg in a comparatively greatly raised position contacts and is braced on the foot piece against further pivotal motions which guarantees the proper operation of the jack during lifting. The load bearing member is as a result not allowed to be pulled from within the friction cone over the point of support of the vehicle. At the same time an overloading of the control brace by undesirable leg motions due to exceeding the above mentioned lifted position is counteracted.

The axial pins have radial arm retaining members positioned so as to straddle the control brace when the axial pins are mounted in it.

When the supporting region of the foot piece is vertically below the center of gravity of the scissors jack, it can be put directly on the ground and without further adjustment pushed under the vehicle so that the load bearing member engages the appropriate place on the vehicle body. With the jack of my invention the vehicle can be raised without problems.

BRIEF DESCRIPTION OF THE DRAWING

The above and other objects, features and advantages of the present invention will become more readily apparent from the following description, reference being made to the accompanying highly diagrammatic drawing in which.

SPECIFIC DESCRIPTION

Figure 2:
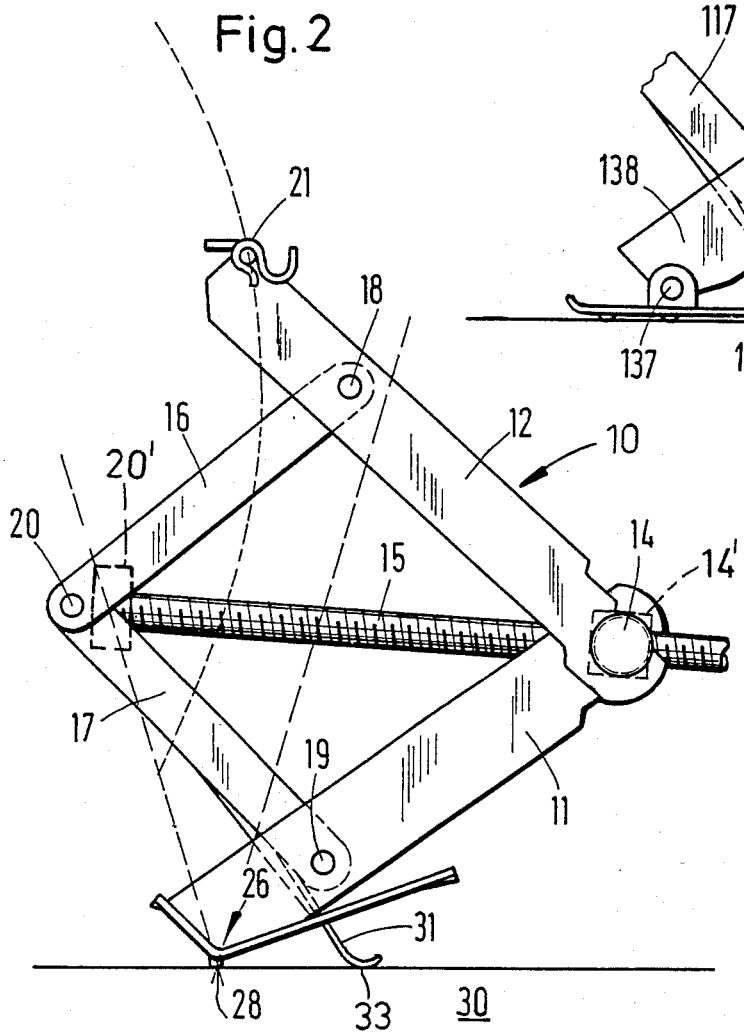
FIG. 2 is side elevational view of the scissors jack of FIG. 1 in its highest starting configuration in which it is positioned to engage the appropriate position on a vehicle to be lifted or which has been lifted.
Figure 1:
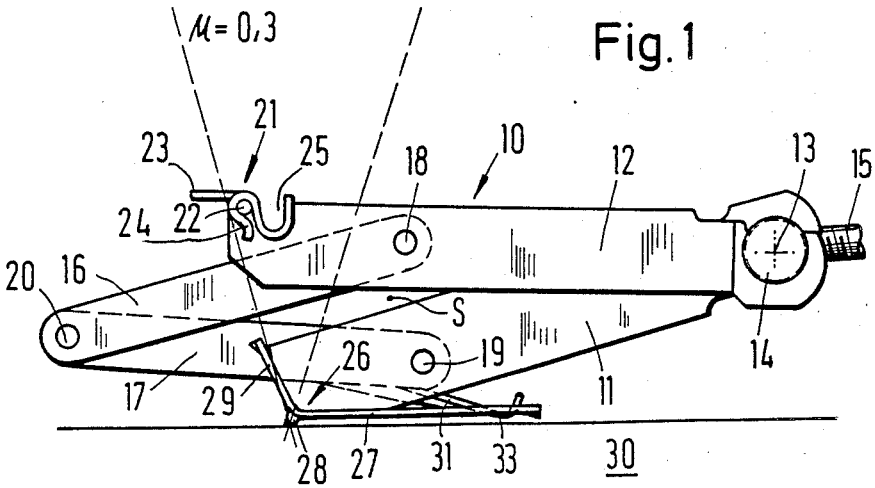
FIG. 1 is a schematic side elevational view of a scissors jack according to one embodiment of my invention in its lowered configuration.

The scissors jack 10 shown in FIGS. 1 and 2 includes a leg 11 and a first supporting arm 12 which is mounted on the leg 11 pivotable about a horizontal pivot axis 13. The pivot axis 13 is defined by a pivot pin 14 on a jack screw nut 14' through which a jack screw 15 is screwed.

Second and third supporting arms 16 and 17, which also can be described as braces are connected with the leg 11 and the first supporting arm 12 at pivot axes 18 and 19, which are positioned in the upper half of the first supporting arm 12 and in the lower half of the leg 11 respectively.

The second and third supporting arms 16 and 17 are connected at their other ends by a joint, which is formed by the pivot pin 20 of a jack screw mounting bearing 20'.

An end of the jack screw 15 engages in this jack screw bearing 20' while its other end is rotatable by a hand crank. Thus the jack screw bearing 20' must allow both the rotation of the jack screw 15 and the pivotal motion of the second and third supporting arms 16 and 17. The jack screw bearing 20' and also the previously mentioned jack screw nut 14' are described in more detail in the German Patent Document-Open Application DE-OS No. 24 27 443.

At the free end of the first supporting arm 12 a load bearing member 21 comprises a mounting plate having a hinge like structure and mobility, which is partially pivotable about a pivot axis 22 on the first supporting arm 12. The position of the load bearing member 21 on the first supporting arm 12 and/or on the pivot axis 22 is secured by a retaining piece 24. The load bearing member 21 has a mounting surface 23 for engaging the body of the vehicle to be lifted. Moreover a recess 25 is present in which a body plate weld seam can be positioned, so that the scissors jack 10 cannot slide away from the vehicle body. This form of the load bearing member 21 is described in German Patent DE-PS No. 28 01 735.

According to FIGS. 1 and 2 a foot piece 26 formed as a roller foot is present at the lower end of the leg 11, sits rigidly on leg 11 and has a roller edge 28 between a supporting surface 27 and an upright surface 29.

The supporting surface 27 defines a supporting region of the foot piece 26 over which the center of gravity S is positioned, so that the scissors jack 10 can be placed on the ground 30 without tipping.

On the third supporting arm 17 adjacent the leg 11 a control brace 31 has an end adjacent leg 11 provided with a curved supporting surface 33 directed toward leg 11 which also is convex toward the ground 30. The curved control surface 33 guarantees that the control brace 31 is continually supported on a sufficiently large surface on the ground 30. Bracing the jack 10 on an edge of a component is avoided.

The control brace 31 diverges from the longitudinal axis of the third supporting arm 17 toward the ground 30. As a result the pivot axis 19 is positioned in the region of the end of the leg 11 apparent from the drawing which must be avoided by the control brace 31 during jack operation.

The leg 11 and the first supporting arm 12 comprise for example U-shaped cross section supporting bars, whose U-shaped body is cut away in the vicinity of the pivot axis 13 to guarantee the required motion play. The second and third supporting arms 16 and 17 for example are twin bars held spaced from each other which can also have a U-shaped cross section.

FIG. 2 shows a configuration of the scissors jack 10 in which the pivot pins 14 and 20 are pushed together in contrast to FIG. 1 by operation of the jack screw 15, so that the parallelepiped formed by the leg and arms of the jack 10 is correspondingly spread and the load bearing member 21 takes the highest position above the foot piece 26. It has moved from its position shown in FIG. 1 to the right over the roller edge 28 as is apparent in FIG. 2. It is continually in the friction cone for $\mu=0.3$. Thus the course of the load bearing member 21 is shown with dashed lines in FIG. 2.

This control of the load bearing member 21 and/or the scissors jack 10 is achieved by the appropriate dimensioning of the control brace 31. The vehicle can be lifted from the lowest starting configuration of the jack 10 shown in FIG. 1 and from the highest configuration starting shown in FIG. 2 without the jack slipping. On lifting of the vehicle the control brace 31 is largely off the ground and the load bearing member 21 follows the upward course of the vehicle carriage.

Since the control brace 31 according to FIG. 2 engages the foot piece 26 formed as a rigid roller foot mounted on leg 11 in the course of its motion, this foot piece must have a suitable recess for it and/or the control brace must be surrounded by both sides of the supporting surface of the foot piece 26. Accordingly in the alternative embodiment of my invention shown in FIG. 3 the foot piece 126 is constructed in contrast as a supporting plate which is pivotable at its pivot axis 137 at the lower end 138 of the leg 111.

The supporting surface 127 of this foot piece 126 rests continuously on the ground 30 and the control brace 131 of the supporting arm 117 is supported itself on the inner surface 134 of the foot piece 126, so that the same positive supporting conditions result.

Figure 3:
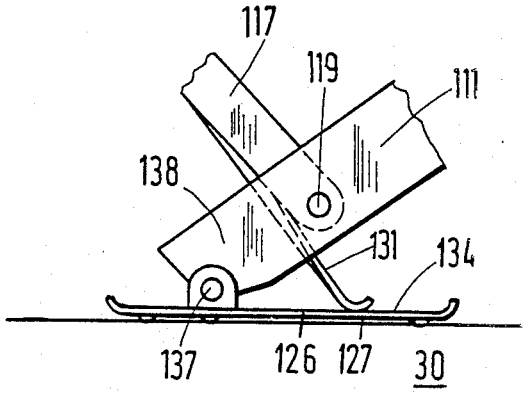
FIG. 3 is a partial cutaway side elevational view of another embodiment of the scissors jack of my invention showing particularly the foot piece.

The scissors jack 210 of the embodiment shown in FIGS. 4 to 6 corresponds largely to the jack of FIGS. 1 to 3 and differs from it as described below. The drawing shows the jack screw nut 214' through which the jack screw 215 is screwed. At the pivot pin 220 a U-shaped fitting 252 is attached on whose U-base a jack screw mounting bearing 254 is mounted. In this jack screw bearing 254 an end of the jack screw 215 is engaged whose other end is rotatable by a hand crank.

At the lower end of the leg 211 a foot piece 226 formed as a support plate is pivotally mounted so that it can execute a hinge like motion about the pivot axis 237. A supporting surface of this foot piece 226 rests continually on the ground 30 and is mounted on antislip strips 255 and/or extensions 256 on the ground side of the foot piece 226 and composed of for example rubber. These antislip strips 255 and extensions 256 prevent slipping of the foot piece 226 particularly on smooth or compressible ground. The supporting point 241 of the leg 211 on the foot piece 226 is positioned in the vicinity of the antislip strips 255 and the extensions 256.

The first supporting arm 212, the second and third supporting arms 216 and 217, and the leg 211 are formed with U-shaped cross sectioned supporting arms.

The U-shaped cross sectioned arms are widened near the jack screw bearing 254 toward the outside to provide a place necessary for the jack screw bearing 254 when the jack is collapsed or completely cranked together. The U-shaped body of the leg 211 is hollowed out near its lower end 238. The edges 257 formed by the legs of the U-shaped cross section of the leg 211 present in the vicinity of the opening 258 have reinforcing pieces 251 directed to the exterior.

The reinforcing pieces 251 are so formed that they are positioned parallel to the foot piece 226 and/or to the supporting surface 227 in the resting configuration of the scissors jack 210. They are formed on the jack screw side of the supporting point 241. They run at an angle apparent from the drawing and upright surfaces 229 allow the leg 211 to be supported in its highest position on the foot piece 226 on the other side of the supporting point 241.

In the opening 258 between the side walls 259 of the leg 211 a control brace 240 is positioned, which is mechanically coupled at one end to the third supporting arm 217 and at the other end to the foot piece 226. The coupling occurs at the pivot joints 242 and 243.

The pivot joint 242 lies approximately in the horizontal plane of the pivot axis 237, while the pivot joint 243 is positioned under the line of connection 248, which connects the pivot axis 219 with the pivot pin 220. As a result the control brace 240 is comparatively short. The jack 210 can be collapsed to a very flat configuration without disturbing the control brace 240. In the structure of the collapsed jack 210 in the vehicle a component of the jack 210 is connected with the foot piece 226 under tension which results in a jack 210 stored in a comparatively rattle free manner.

Figure 5:
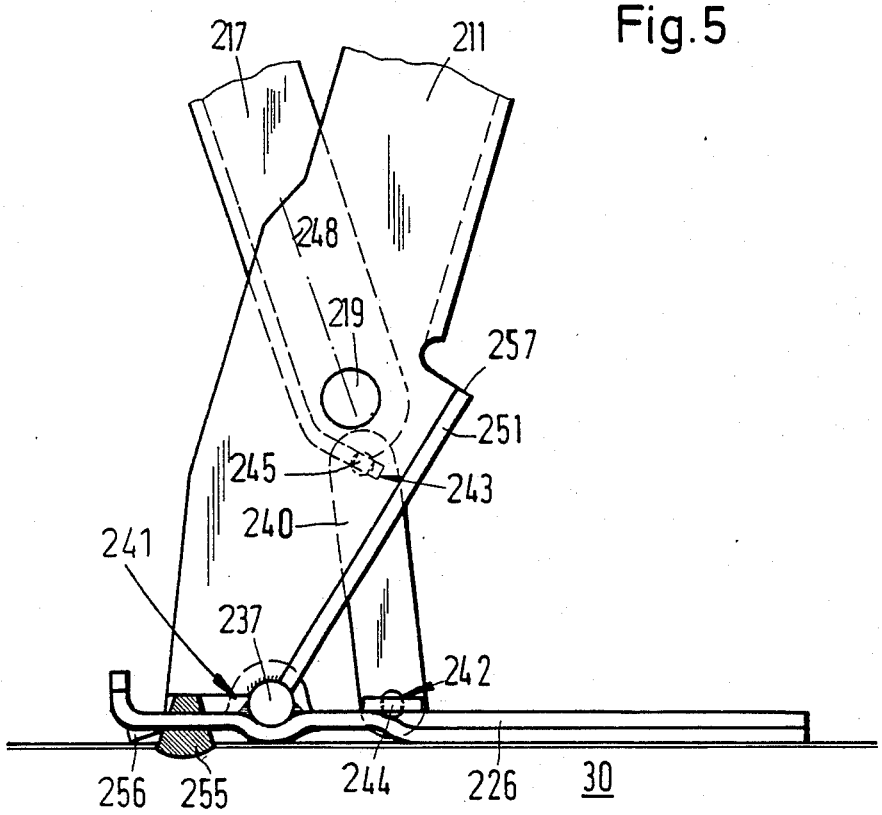
FIG. 5 is a partial cutaway side elevational view of the scissors jack of FIG. 4 in its highest raised position.
Figure 6:
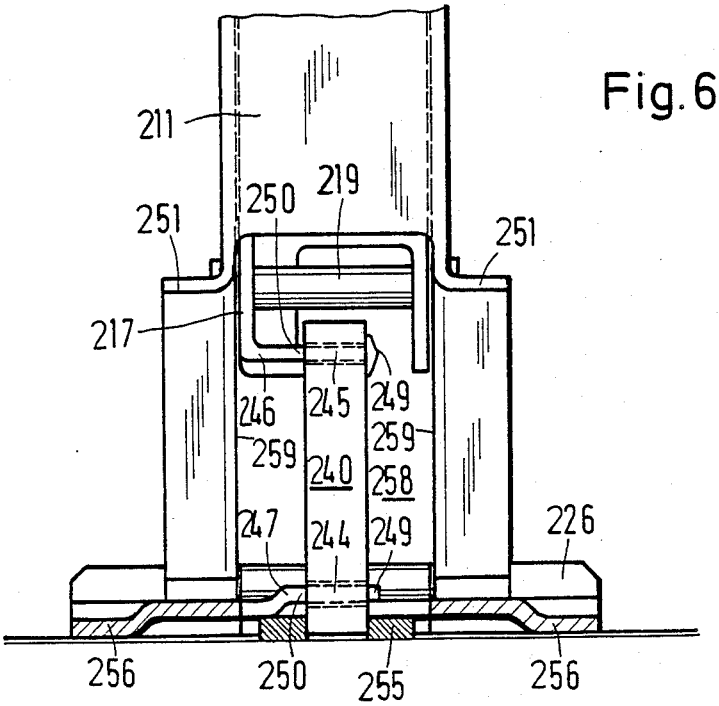
FIG. 6 is a partial cutaway rear elevational view of the scissors jack of FIG. 5.

The pivot joints 242 and 243 are formed by axial pins 244 and 245 as seen in FIG. 6. These axial pins 244 and 245 are integral components of a bent piece 246 of the third supporting arm 217 and a projecting member 247 of the foot piece 226. FIGS. 5 and 6 show that the bent piece 246 is angled out of the plane of the third supporting arm 217 and moreover parallel to the pivot axis 219. The bent piece 246 penetrates through the control brace 240 and has arm retaining members 249 and 250 on both sides of the control brace 240 which act to secure the position of the control brace 240. From the drawing it is apparent that these arm retaining members 249 and 250 can be made by punching out the bent piece 246 wider from the thick material of the third supporting arm 217 than the corresponding hole diameter of the control brace 240. A manufacture similar to that of arm retaining members 249 and 250 is used for the projecting member 247 of the foot piece 226. The projecting member 247 is such that the axial pin 244 is essentially at the same height as the pivot axis 237.

The pivot pins 244 and 245 of the bent piece 246 and/or the projecting member 247, which can be made by punching out, either according to FIG. 5 remain four cornered or can be pressed round in the making of the third supporting arm 17 in a step along with its manufacture.

The control brace 240 has holes fitting the corresponding pivot pins 244 and 245 so that relative motion between it and the third supporting arm 217 and/or the foot piece 226 is provided. In as much as the control brace 240 is composed of an elastic material, particularly rubber, in assembly of the control brace with the foot piece 226 and/or the supporting arm 217 the control brace can be pushed over the arm retaining members 249 and snapped on the pivot pins 244 and 245. In case where the control brace is not elastic but made of steel the arm retaining members 249 are made after the control brace 240 has been placed on the pivot pins 244 and 245, for example by squeezing.

Figure 4:
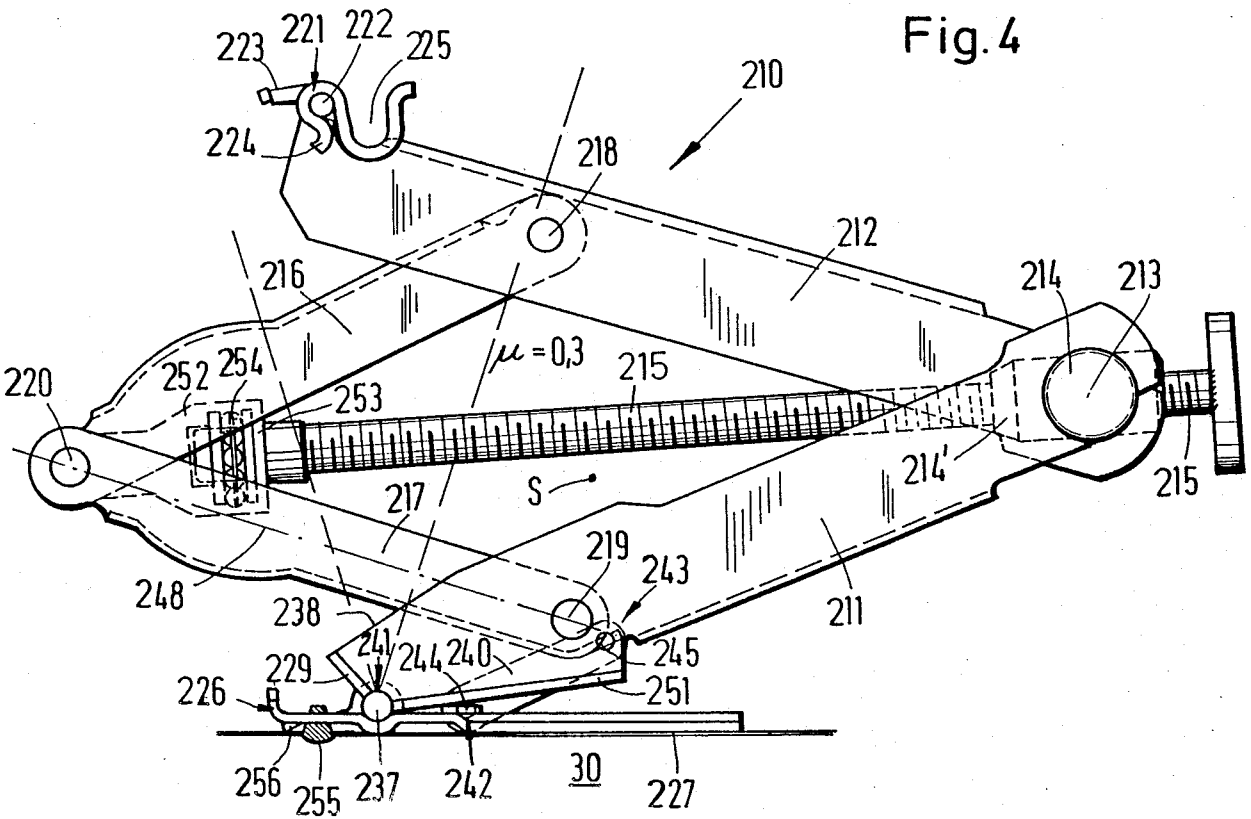
FIG. 4 is a schematic side elevational view of a third embodiment of the scissors jack according to my invention in its lowered configuration.

FIG. 4 shows a configuration of the scissors jack 210 which corresponds to the lowest allowed starting height of the part of the vehicle to be lifted which engages in the load bearing member 221 from the ground 30. The jaok screw 215 is rotated so that the jack screw bearing 254 approaches the jack screw nut 214' and the pivot pins 213 and 220 are pushed together. As a result the parallelepiped shaped scissors jack 210 rises and the load bearing member 221 takes a higher position over the foot piece 226. It never leaves however the friction cone for $\mu=0.3$ for example above the point of support 241 of the leg 211 on the foot piece 226. On lifting the vehicle from an initial engaged position with the scissors jack 210 no horizontal forces sliding the scissors jack 210 to the left or to the right can be exerted. Thus the vehicle can be raised from its lowest position as shown in FIG. 4 to the highest position as shown in FIG. 5 without slipping.

I claim:

1. A scissor jack for lifting a body of a vehicle above the ground, the jack comprising:

a leg having a lower end adapted to bear on the ground and an opposite upper end;

a support arm having a lower end pivoted on the opposite upper end of the leg at an intermediate horizontal axis and an opposite upper end;

a load-bearing member engageable with the vehicle body and formed on the opposite upper end of the intermediate support arm;

upper and lower links pivoted together at another intermediate horizontal axis, the upper link being pivotally connected to the support arm between the ends thereof at an upper horizontal link axis, the lower link being pivotally connected to the leg between the ends thereof at a lower horizontal link axis;

a jack screw operatively connected to the leg, arm, and links at the intermediate axes and rotatable in one direction to draw the intermediate link axes toward one another to raise the load-bearing member and rotatable in the opposite direction to separate the intermediate link axes to lower the load-bearing member;

a foot piece on the lower end of the leg;

pivot means on the foot piece to rock the lower end of the leg relative to the ground about a lower horizontal foot axis as the leg is raised and lowered; and a control brace fixed on the lower link and projecting therefrom past the leg and beyond the lower horizontal link axis to support the jack in a raised position of the load-bearing member with the lower link axis above the ground, the control brace having an outer end operatively engageable with the ground and forming a lower horizontal brace axis spaced from the axes such that it always defines with the lower foot axis a plane generally parallel to a plane defined by the intermediate link axes.

2. The scissor jack defined in claim 1 wherein the foot piece is formed rigidly on the lower end of the leg and has a pair of portions extending at an obtuse angle to each other from the lower foot axis.

3. The scissor jack defined in claim 2 wherein one of the portions is formed with an opening through which the control brace extends to directly engage the ground at the brace axis.

4. The scissor jack defined in claim 1 wherein the control-brace outer end is rounded and centered on the brace axis.

5. The scissor jack defined in claim 1 wherein the control-brace outer end is rounded.

6. The scissor jack defined in claim 1 wherein the control-brace outer end engages the foot piece and is operatively engageable via same with the ground.

* * * * *